United States Patent [19]

Giles

[11] Patent Number: 4,543,277

[45] Date of Patent: Sep. 24, 1985

[54] METHOD AND APPARATUS FOR COATING PLASTICS BOTTLES

[75] Inventor: Brian Giles, Manchester, England

[73] Assignee: GOM International Ltd., Gibralter, England

[21] Appl. No.: 554,560

[22] Filed: Nov. 23, 1983

[30] Foreign Application Priority Data

Dec. 3, 1982 [GB] United Kingdom ..... 8234483

[51] Int. Cl.[4] ..... B05D 1/18

[52] U.S. Cl. ..... 427/430.1; 118/416; 118/423

[58] Field of Search ..... 118/416, 423, 424, 407, 118/429, 426; 427/430.1

[56] References Cited

U.S. PATENT DOCUMENTS

| | | | |
|---|---|---|---|
| 2,195,670 | 4/1940 | Ferngren | 118/416 |
| 2,821,158 | 1/1958 | Brown et al. | 118/416 |
| 3,341,353 | 9/1967 | Johnson | 118/416 |
| 3,530,825 | 9/1970 | Antonissen | 118/416 |
| 3,999,509 | 12/1976 | Lucas | 118/416 |

*Primary Examiner*—Shrive P. Beck

*Attorney, Agent, or Firm*—Fiddler & Levine

[57] ABSTRACT

A method of coating a container (1) including a structure defining an aperture comprises the steps of supporting the container (1) by the said structure, causing the container (1) to rotate about an axis thereof, causing the rotating container (1) to translate across the surface of a liquid coating composition (7) a portion of the container being immersed in the composition, and causing the composition to solidify upon the surface of the container. The method is particularly applicable to coating plastics bottles.

8 Claims, 3 Drawing Figures

METHOD AND APPARATUS FOR COATING PLASTICS BOTTLES

This invention relates to a method for coating plastics bottles, and to an apparatus for use in carrying out the method.

Plastic bottles are commonly used for storage of carbonated beverages. The gaseous pressure developed within such bottles has restricted use of small plastics bottles, for example having a capacity of 250 $cm^3$. The relatively high surface area of such small bottles results in leakage of gas upon storage for prolonged periods. Leakage is also a problem with larger bottles.

According to a first aspect of the present invention a method of coating a container including a structure defining an aperture comprises the steps of supporting the container by the said structure, causing the container to rotate about an axis thereof, causing the rotating container to translate across the surface of a liquid coating composition a portion of the container being immersed in the composition, and causing the composition to solidify upon the surface of the container.

The method is particularly applicable to coating plastics bottles which are preferably secured by the necks thereof. Containers not including a neck may be supported by a member inserted into the aperture.

Rotation of the container serves to provide a coating of uniform thickness.

Preferably the container is caused to rotate about a generally horizontal axis.

More preferably the container is caused to rotate about a horizontally disposed axis of symmetry. The container may be cylindrical although a container having many sides may be coated by this method.

The container may be caused to skim across the surface of the composition, the depth of immersion in the composition determining the thickness of the resultant coating.

Rotation of the container preferably continues as the composition solidifies.

The container may be arranged after translation across the liquid composition, to rotate with the axis thereof inclined to the horizontal, for example at 45°. Excess liquid coating composition may thereby drain from the container.

Solidification of the coating upon the container may be caused to occur after the excess composition has been removed by passage through an oven.

When the container comprises a shoulder leading to a neck or other constriction, the shoulder may be coated by passage over a platform extending above the body of the liquid composition, liquid composition being caused to flow over the platform and to contact the container as it passes.

When the container is a bottle, the coating composition is preferably prevented from contacting the neck thereof so that the screw thread or other means of closure is not coated. The means of supporting the container is also kept clear of the composition.

The composition preferably comprises a latex or any other convenient liquid which serves to seal the container and prevent escape of the contents thereof.

According to a second aspect of the present invention apparatus for coating a container including a structure defining an aperture comprises means for engaging said structure and supporting the container, means for rotating the container about an axis thereof and means for translating the rotating container across the surface of a liquid coating composition with a portion of the container being immersed in the composition.

The apparatus may comprise part of an endless conveyor of a larger apparatus used to manufacture the containers. The container is preferably a plastics bottle and the said structure may comprise the neck thereof.

The means for engaging the structure preferably facilitates rotation thereof, the container either being loosely engaged so that it is free to rotate or the means including an articulated linkage adapted for rotational movement.

Means for engaging the neck of a bottle may comprise a U-shaped member, an aperture within which a collar on the neck may be engaged or any other convenient arrangement.

The means for rotating the container preferably comprises a surface having a high coefficient of friction adapted to engage the structure as it passes along the conveyor. Alternatively, a surface may be adapted to cooperate with the means for engaging the neck of the bottle and cause the latter to rotate as it translates across the coating composition.

The coating composition may be disposed in a bath containing a weir to maintain the liquid level at a constant location. There may be a platform, plate or other member located above the liquid level and provided over the surface with a constant flow of coating composition. The shape of the plate is preferably arranged to cooperate with the neck or other contour of the container to provide even coating thereof.

The apparatus may also comprise means adapted to rotate the container after it has been removed from the bath, the container being preferably inclined to the horizontal, for example at an angle of 45°.

The apparatus may further comprise an oven adapted to cause solidification of the coating.

The invention is further described by means of example with reference to FIGS. 1 to 3 of the accompanying drawing, of which:

FIG. 1 shows a partial view of an apparatus in accordance with the invention with a bottle supported in three different attitudes.

Figure 1:
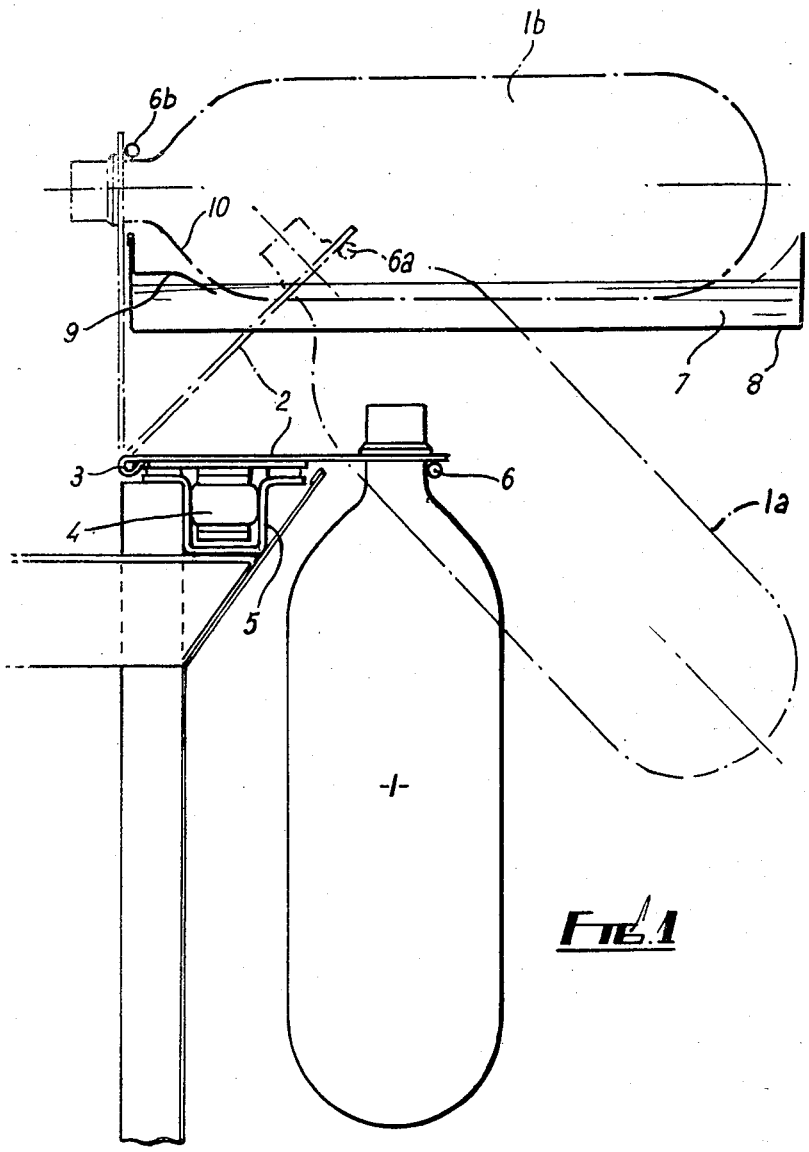
FIG. 1 illustrates part of an apparatus in accordance with the invention.

The apparatus is adapted to receive an endless supply of bottles from a moulding station (not shown), the bottle 1 being received in a vertical orientation. The apparatus comprises a neck support member 2, hinged at 3 to a drive mechanism comprising a roller 4. The roller 4 is constrained to movement within a track 5. The bottle 1 is supported by the neck in a slot in the member 2. The end of the member 2 remote from the hinge 3 rests on a guide rail 6. The vertical location of the guide rail 6 alters during passage of the member 2 along the track 5, passing through an intermediate position 6*a* in which the bottle 1*a* is inclined at 45°, to a position 6*b* in which the bottle 1*b* is disposed horizontally. The bottle 1*b* may then translate across the surface of a liquid coating composition 7 contained in a bath 8. The bottle 1*b* is caused to spin axially as it translates across the composition 7, causing the sides thereof to be coated with the composition. Coating is applied to the shoulder of the bottle 10 by means of a platform 9 arranged so that the bottle passes adjacent to it within the bath 8. A stream of the composition passes over the platform to coat the shoulder 10 as the bottle rotates.

Figure 2:
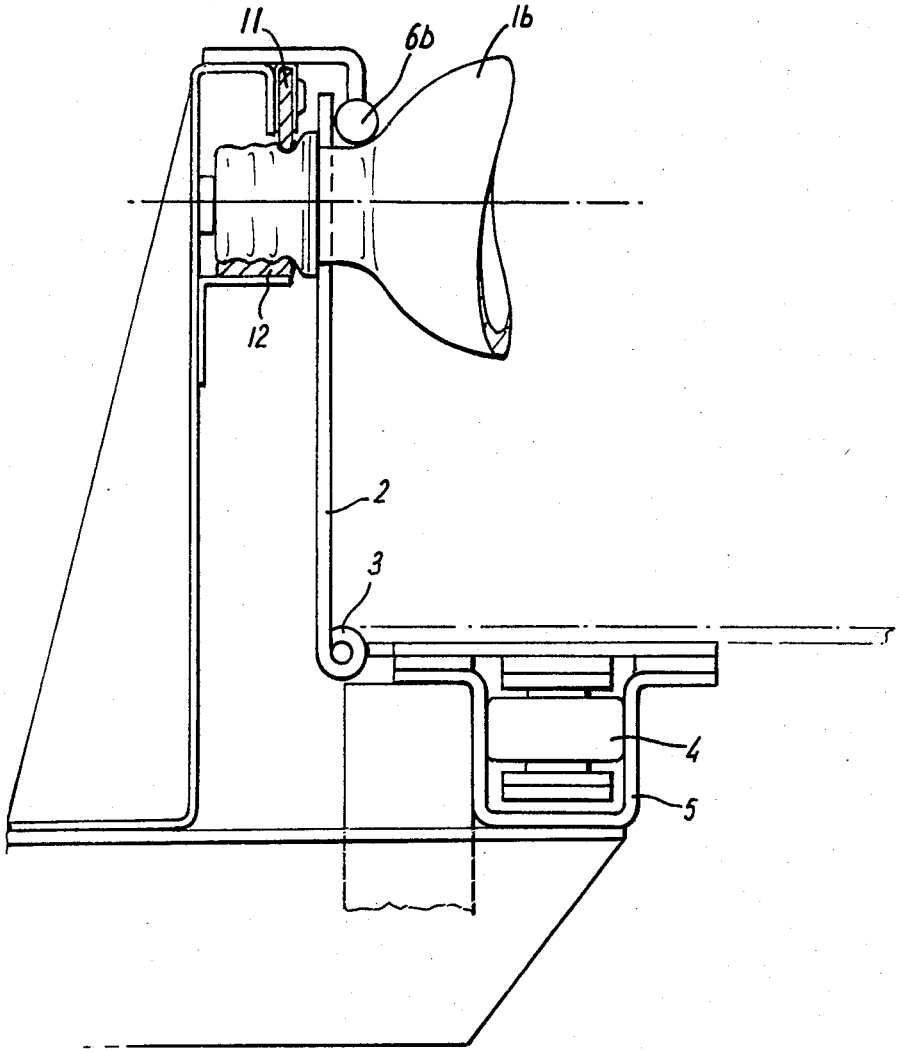
FIG. 2 illustrates detailed construction of the apparatus shown in FIG. 1.

The mechanism which causes the bottle to rotate is illustrated in FIG. 2. The neck of the bottle 1*b* loosely located in the slot in the member 2 is urged by a roller 11 into engagement with a pad 12 which extends continuously over the length of the bath and subsequent drying stations. Friction between the pad 12 and bottle 1*b* causes the latter to rotate.

Figure 3:
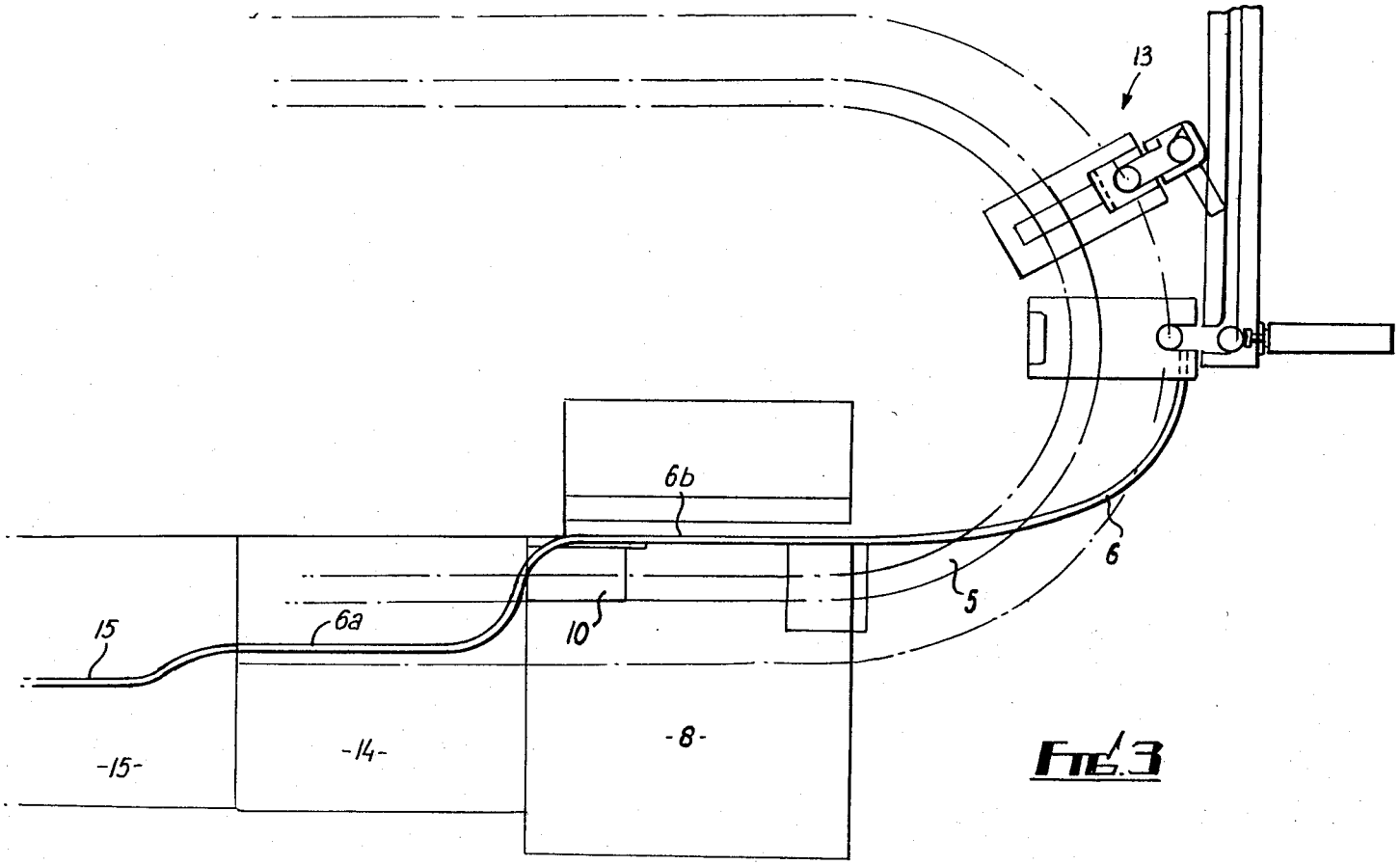
FIG. 3 is a plan view of the apparatus.

FIG. 3 illustrates a plan view of the layout of the apparatus, which forms part of a conveyor for manufacture of plastics bottles. The bottle moulding station is indicated generally at 13.

The bottles supported by respective members 2 (not shown) are caused to adopt a horizontal attitude by the guide rail 6 moving upwardly and laterally relative to the track 5. The position of the rail 6*b* in which the bottle passes across the bath 8 of coating composition is shown. The platform 10 which serves to coat the necks of the bottles is located at the downstream end of the bath. After passage through the bath the bottles move to a location where the guide rail 6*a* causes them to be inclined at 45°. Excess coating composition drains from the spinning bottles and is collected in a tray 14. The guide rail then moves to a dispostion relative to the members 2 in which the bottles pass vertically through a drying oven. The bottles may remain in the oven at a temperature of 60° C. for a period of 90 seconds.

What I claim is:

1. A method of coating a plastic bottle having a neck defining an aperture, said method comprising the steps of: supporting the bottle by the bottle neck; rotating the bottle about a horizontal axis; passing the horizontally rotating bottle across the upper surface of a bath of liquid coating material such that the bottle skims the surface of the bath of coating material and contact between the bottle and the bath only occurs while the bottle is rotated about a horizontal axis; removing the bottle from contact with the surface of the bath; and, solidifying the coating material on the surface of the bottle while continuing to rotate the bottle.

2. A method as in claim 1, wherein said step of supporting the bottle neck is performed by inserting a member into the aperture defined by the neck.

3. A method as in claim 1, wherein the bottle is rotated with the axis of rotation inclined to the horizontal while the composition is caused to solidify.

4. A method as in claim 1, wherein the bottle comprises a shoulder leading to the neck, said method including the steps of passing the shoulder over a platform extending above the body of the liquid composition; and flowing liquid composition over the platform to contact the shoulder.

5. Apparatus for coating a plastic bottle having a neck defining an aperture, said apparatus comprising: means for engaging the neck and supporting the bottle; means for rotating the bottle about a horizontal axis; a bath of liquid coating material; means for passing the rotating bottle across the upper surface of the bath as it rotates about a horizontal axis so as to skim the upper surface of said bath, contact between the bottle and the bath only occurring while the bottle is rotated about its horizontal axis; means to remove the bottle from contact with said bath; and, means to rotate the bottle after it has been removed from said bath.

6. Apparatus as in claim 5, wherein said means for engaging said neck causes rotation of the bottle.

7. Apparatus as in claim 6 wherein the bottle has a collar located at the neck thereof, and said means for engaging the neck comprises a U-shaped member having an aperture within which said collar may engage.

8. Apparatus as in claim 5, wherein said means for rotating the bottle comprises a surface having a high coefficient of friction adapted to engage said neck.

* * * * *